US006299708B1

(12) United States Patent
Choh et al.

(10) Patent No.: US 6,299,708 B1
(45) Date of Patent: Oct. 9, 2001

(54) CARBIDE DISPERSED, STRENGTHENED COPPER ALLOY

(75) Inventors: Takao Choh, Aichi; Hirohiko Fujimaki, Shizuoka; Yuji Nitta, Shizuoka; Takuya Miyakawa, Shizuoka, all of (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/122,869

(22) Filed: Jul. 27, 1998

(30) Foreign Application Priority Data

Jul. 29, 1997 (JP) ..... 9-203143

(51) Int. Cl.[7] ..... C22F 3/00

(52) U.S. Cl. ..... 148/553; 148/536; 148/554; 164/97

(58) Field of Search ..... 148/553, 554, 148/536; 164/97

(56) References Cited

FOREIGN PATENT DOCUMENTS 61 099606 * 5/1986 (JP) .
2-19177 4/1990 (JP) .
4-2416 1/1992 (JP) .

OTHER PUBLICATIONS

Ichikawa, Kiyoshi; Achikita, Masakazu, Production and properties of carbide dispersion–strengthened coppers by compocasting, ISIJ Int. (1991), 31(a), 985–91 (Whole Article), 1991.*

Ichikawa, Kiyoshi; Achikita, Masakazu, Production and properties of carbide dispension–strengthened coppers by compocasting, ISIJ Int. (1991), 31(a), 985–91 (Abstract Only), 1991.*

* cited by examiner

*Primary Examiner*—Sikyin Ip
(74) *Attorney, Agent, or Firm*—Armstrong, Westerman, Hattori, McLeland & Naughton, LLP

(57) ABSTRACT

A carbide dispersed, strengthened copper alloy includes copper as a major constituent, carbide particles, and a dispersing agent. The carbide particles consist of one or more carbides selected from chromium carbide, tungsten carbide, molybdenum carbide, and tantalum carbide. The dispersing agent consists of one or more elements selected from magnesium, chromium, silicon, and aluminum.

4 Claims, No Drawings

CARBIDE DISPERSED, STRENGTHENED COPPER ALLOY

BACKGROUND OF THE INVENTION

1. Field of the Invention

The present invention relates to a strengthened copper including a dispersed carbide.

2. Prior Art

To provide an electrically conductive material having a sufficient strength in a high temperature, there has been used a strengthened copper including dispersed particles consisting of alumina or the like. The strengthened copper may be called a particle dispersed, strengthened copper. The strengthened copper is produced basically by a process of powder metallurgy. For example, regarding an oxide strengthened copper, a powder copper raw material is mixed with copper oxide powder. Subsequently, the particles of the copper oxide powder can be evenly dispersed in matrices of the copper elements during oxidation due to the copper oxide powder. Meanwhile, a carbide dispersed copper is obtained by mixing a powder copper raw material with a carbide in a mechanical alloying process.

Thus produced copper alloys are formed into electric conductors in desired product sizes by the plastic forming of hot extrusion after solidification thereof.

However, these known strengthened coppers have been little commercially produced because of a significantly high production cost due to their long, complicated production processes.

To solve the problem, modified molding methods have been proposed However, a satisfactory result has not been attained For example, Japanese Patent Laid-open No. 2-19177 proposes a method, in which carbide particulates are added in pure copper and they are molten by heating. The melt is mechanically stirred at a high speed of 1500 rpm and is cooled until solidification of the melt. This forcibly evenly disperses the carbide particulates in matrixes of copper elements. However, such stirring apparatuses are high in installation cost, and moreover, this method provides only a product having a low tensile strength of the order of 400 $N/mm^2$ (newton/square millimeter).

SUMMARY OF THE INVENTION

In view of the problems in the prior arts, an object of the present invention is to provide a carbide dispersed, strengthened copper alloy that has a high tensile strength at a high temperature (400° C.) and has a high electrical conductivity. Furthermore, the alloy is not expensive in production.

To achieve the object, a production method of a carbide dispersed, strengthened copper alloy according to the invention includes the steps of: adding carbide particles and a dispersing agent into a bath containing a molten-metal that includes copper as a major constituent, and string said molten-metal in the bath.

Furthermore, a carbide dispersed, strengthened copper alloy according to the invention includes copper as a major constituent, carbide particles, and a dispersing agent. The carbide particles may consist of one or more carbides selected from chromium carbide, tungsten carbide, molybdenum carbide, and tantalum carbide. The dispersing agent may consist of one or more elements selected from magnesium, chromium, silicon, and aluminum.

DETAILED DESCRIPTION OF PREFERRED EMBODIMENTS

In the invention, the carbide particles preferably have a smaller wetting angle to the molten-metal including copper as a major constituent. As such carbide particles, there are chromium carbide (for example, $Cr_3C_2$), tungsten carbide (for example, WC), molybdenum carbide (for example, $Mo_2C$), and tantalum carbide (for example, TaC).

Moreover, these carbides each preferably have a specific gravity close to that of the molten-metal alloy. The specific gravity of the basic molten-metal alloy is around 8.9.

Table 1 shows wetting angles of the carbides to the molten copper, and shows the specific gravity values thereof (based on a technical literature).

TABLE 1

| | $Cr_3C_2$ | WC | $Mo_2C$ | TaC |
|---|---|---|---|---|
| Wetting Angle | 47° | 7 to 30° | 0 to 18° | 36 to 75° |
| Specific Gravity | 6.7 | 15.6 | 9.1 | 14.5 |

Trichrominum dicarbide ($Cr_3C_2$) has the most preferable character among carbides shown in Table 1.

In addition, the quantity of the added carbides is preferably not less than 0.5 and not more than 20 weight units to the molten copper of 100 weight units. A carbide weight unit less than 0.5 can not achieve a satisfactory effect in carbide strengthening, while a carbide weight unit more than 20 significantly decreases the product alloy in formability.

The invention requires to add a dispersing agent in the molten-metal. The dispersing agent acts to obtain a carbide dispersed, strengthened copper alloy in which the carbide particles are sufficiently evenly dispersed. As the dispersing agent, one or more elements are selected from magnesium, chromium, silicon, and aluminum. In particular, magnesium can attain the most advantageous effect among these dispersing agents.

The quantity of the added dispersing agent is preferably not less than 0.1 and not more than 2 weight units to the molten copper of 100 weight units. A dispersing agent weight unit less than 0.1 cannot achieve a satisfactory agent effect, while a dispersing agent weight unit more than 2 makes the product alloy brittle to decrease a shock-resistant performance thereof.

In the invention, it is necessary to stir sufficiently the molten-metal that has been added both the carbide and the dispersing agent. The string can be accomplished by an ordinary stirring means (such as mechanical means or electromagnet means), and does not require to operate at a high speed. Such stirring means are not expensive. After both the carbide and the dispersing agent are added in the molten-metal, the stirring operation continues and stops just before a cast ingot is obtained.

Thus obtained carbide dispersed, strengthened copper alloy can be formed into a practical electric conductor material by a rolling or drawing process. It is noted that the above-mentioned cast ingot does not need hot extrusion forming.

Next, a plurality of embodiments of a carbide dispersed, strengthened copper alloy according to the invention will be discussed.

To obtain the plurality of embodiments, carbide particles (5 $\mu$m particle diameter) and a dispersing agent consisting of magnesium, which satisfy weight ratios shown in Table 2, were added in a molten copper (1200° C.). At the same time, each molten copper was continuously stirred by hand so as to evenly disperse the carbide particles in the melts. Then, the molten-metal was filled into a mold having a 15 mm diameter so as to obtain an ingot. After cooled, the ingots each were formed into an electric conductor having a 1 mm diameter by rolling and drawing process.

These electric conductors were checked in mechanical and electrical characteristics at a high temperature (400° C.). The results are also shown in Table 2.

TABLE 2

| | Comparative Example | Example 1 | Example 2 | Example 3 | Example 4 |
|---|---|---|---|---|---|
| Pure Copper | 100 | 100 | 100 | 100 | 100 |
| $Cr_3C_2$ | | 10 | | | |
| WC | | | 10 | | |
| $Mo_2C$ | | | | 10 | |
| TaC | | | | | 10 |
| Mg | 0.5 | 0.5 | 0.5 | 0.5 | 0.5 |
| Tensile Strength at 400° C. ($N/mm^2$) | 301 | 649 | 338 | 321 | 339 |
| Conductivity (% to Pure Cu) | 74.9 | 60.9 | 74.1 | 78.4 | 62.6 |

The resulted data in Table 2 show that the electric conductors made of the carbide dispersed, strengthened copper alloys according to the invention have a sufficient strength at a high temperature (400° C.), and also has a desired electrical conductivity.

Particularly, the electric conductor to which trichrominium dicarbide was added has a tensile strength of 649 $N/mm^2$ at 400° C., which is greater than twice of the strength of 301 $N/mm^2$ of the pure copper conductor at the same high temperature. Moreover, the electric conductor has a satisfactory conductivity which is 60% of that of the pure copper conductor. The carbide dispersed, strengthened copper alloys according to the invention do not require a specialized stirring apparatus and can be produced at a lower cost to advantageously provide electric conductors having a sufficient strength at a high temperature (400° C.).

What is claimed is:

1. A production method of a carbide dispersed, strengthened copper alloy comprising the steps of:

adding carbide particles and a dispersing agent into a bath containing a molten-metal that includes copper as a major constituent, stirring said molten-metal in the bath at a normal speed until a cast ingot is obtained, and forming the cast ingot into an electrical conductor material by a rolling or drawing process, wherein said carbide particle consist of trichrominium dicarbide.

2. A production method set forth in claim 1, wherein said dispersing agent consists of one or more elements selected from magnesium, chromium, silicon, and aluminum.

3. A production method set forth in claim 1, wherein said dispersing, agent consists of magnesium.

4. A production method set forth in claim 1, wherein said normal speed is a speed that can be manually achieved.

* * * * *